US010119364B2

(12) United States Patent
Flores

(10) Patent No.: US 10,119,364 B2
(45) Date of Patent: Nov. 6, 2018

(54) SLEEVE APPARATUS, DOWNHOLE SYSTEM, AND METHOD

(71) Applicant: Juan Carlos Flores, The Woodlands, TX (US)

(72) Inventor: Juan Carlos Flores, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 440 days.

(21) Appl. No.: 15/079,759

(22) Filed: Mar. 24, 2016

(65) Prior Publication Data

US 2017/0275966 A1 Sep. 28, 2017

(51) Int. Cl.
*E21B 34/10* (2006.01)
*E21B 34/14* (2006.01)
*E21B 34/00* (2006.01)

(52) U.S. Cl.
CPC ..... *E21B 34/103* (2013.01); *E21B 34/14* (2013.01); *E21B 2034/007* (2013.01)

(58) Field of Classification Search
CPC ... E21B 2034/007; E21B 34/103; E21B 34/14
See application file for complete search history.

(56) References Cited

U.S. PATENT DOCUMENTS 6,907,936 B2 6/2005 Fehr et al.
7,021,384 B2 4/2006 Themig
7,134,505 B2 11/2006 Fehr et al.
7,353,878 B2 4/2008 Themig
7,543,634 B2 6/2009 Fehr et al.
7,861,774 B2 1/2011 Fehr et al.
7,992,645 B2 8/2011 Themig
8,657,009 B2 2/2014 Themig et al.
8,727,010 B2 * 5/2014 Turner ..... E21B 34/14 166/177.5
9,010,447 B2 4/2015 Themig et al.
9,074,451 B2 7/2015 Themig et al.
9,784,070 B2 * 10/2017 Neer ..... E21B 34/108
2007/0272413 A1 * 11/2007 Rytlewski ..... E21B 34/14 166/318
2016/0237785 A1 * 8/2016 Bacsik ..... E21B 34/10
(Continued)

OTHER PUBLICATIONS

PetroWiki, "Completion flow control accessories", 2015, petrowiki.org, 5 pages.

*Primary Examiner* — Daniel P Stephenson
(74) *Attorney, Agent, or Firm* — Cantor Colburn LLP

(57) ABSTRACT

A sleeve apparatus having a longitudinal axis and an interior further includes a tubular having a plurality of ports providing a length of fluidic access between the interior and an exterior of the tubular, the length measured with respect to the longitudinal axis; and, a sleeve disposed within the tubular and configured to move longitudinally with respect to the longitudinal axis. The sleeve further has a plurality of apertures misaligned with the plurality of ports in a closed condition of the sleeve apparatus and at least substantially aligned with the plurality of ports in a fully open condition of the sleeve apparatus, and a plurality of non-apertured sections aligned with the plurality of ports in the closed condition. A longitudinal shifting distance of the sleeve to move the sleeve apparatus from the closed condition to the fully open condition is less than the length of fluidic access.

20 Claims, 4 Drawing Sheets

(56) References Cited

U.S. PATENT DOCUMENTS

| | | | | |
|---|---|---|---|---|
| 2016/0251939 | A1* | 9/2016 | Johnson | E21B 34/14<br>166/305.1 |
| 2017/0037705 | A1* | 2/2017 | Pabon | E21B 34/14 |
| 2017/0275966 | A1* | 9/2017 | Flores | E21B 34/103 |

* cited by examiner

SLEEVE APPARATUS, DOWNHOLE SYSTEM, AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. A tubular having a radial port and inserted within the borehole is used for allowing the natural resources to flow within the tubular through the radial port to a surface or other location, or alternatively to inject fluids from the surface through the radial port and to the borehole.

As shown in FIGS. 4A-4C, a sleeve apparatus 10 having an actuatable sleeve 12 is slidable within a tubular 14 to provide an interior of the sleeve apparatus 10 access to the radial ports 16 in the tubular 14. In a closed position, as shown in FIG. 4A, the sleeve 12 blocks access to the ports 16. When it is desired to open the ports 16, to provide fluid communication between the interior of the sleeve apparatus 10 and an exterior of the tubular 14, a ball 18, is dropped onto a seat 20 and hydraulic pressure within the interior is increased to move the sleeve 12 until the ports 16 are exposed as shown in FIG. 4C. However, if the ports 16 are too long and the pressure drop while the sleeve 12 is exposing the ports 16 is too fast or too high, then the sleeve 12 may not reach the end of its displacement and the ports 16 may not be fully opened, as shown in FIG. 4B. Further, if the sleeve 12 does not reach the end of its displacement as the system 10 is designed to, then the sleeve 12 may not lock into place as intended.

Thus, the art would be receptive to improvements in actuatable sleeves for downhole systems.

BRIEF DESCRIPTION

A sleeve apparatus having a longitudinal axis and an interior further includes a tubular having a plurality of ports providing a length of fluidic access between the interior of the sleeve apparatus and an exterior of the tubular, the length measured with respect to the longitudinal axis; and, a sleeve disposed within the tubular and configured to move longitudinally with respect to the longitudinal axis, the sleeve having a plurality of apertures misaligned with the plurality of ports in a closed condition of the sleeve apparatus and at least substantially aligned with the plurality of ports in a fully open condition of the sleeve apparatus, the sleeve further having a plurality of non-apertured sections aligned with the plurality of ports in the closed condition. A longitudinal shifting distance of the sleeve to move the sleeve apparatus from the closed condition to the fully open condition of the sleeve apparatus exposing the plurality of ports to the interior of the sleeve apparatus is less than the length of fluidic access provided by the plurality of ports in the fully open condition.

A downhole system includes an assembly configured to extend through a borehole, the assembly having an interior defining a flowbore. The downhole system further includes a sleeve apparatus connected along the assembly, the sleeve apparatus having a longitudinal axis and an interior, the sleeve apparatus further including a tubular having a plurality of ports providing a length of fluidic access between the interior of the sleeve apparatus and an exterior of the tubular, the length measured with respect to the longitudinal axis; and, a sleeve disposed within the tubular and configured to move longitudinally with respect to the longitudinal axis, the sleeve having a plurality of apertures misaligned with the plurality of ports in a closed condition of the sleeve apparatus and at least substantially aligned with the plurality of ports in a fully open condition of the sleeve apparatus, the sleeve further having a plurality of non-apertured sections aligned with the plurality of ports in the closed condition. A longitudinal shifting distance of the sleeve to move the sleeve apparatus from the closed condition to the fully open condition of the sleeve apparatus exposing the plurality of ports to the interior of the sleeve apparatus is less than the length of fluidic access provided by the plurality of ports in the fully open condition.

A method of accessing an annulus in a borehole includes running a downhole assembly into a borehole, the downhole assembly having an interior defining a flowbore, and further including a sleeve apparatus connected along the assembly, the sleeve apparatus having a longitudinal axis and an interior, the sleeve apparatus further including a tubular having a plurality of ports providing a length of fluidic access between the interior of the sleeve apparatus and an exterior of the tubular, the length measured with respect to the longitudinal axis; and, a sleeve disposed within the tubular and configured to move longitudinally with respect to the longitudinal axis, the sleeve having a plurality of apertures misaligned with the plurality of ports in a closed condition of the sleeve apparatus and at least substantially aligned with the plurality of ports in a fully open condition of the sleeve apparatus, the sleeve further having a plurality of non-apertured sections aligned with the plurality of ports in the closed condition. The method further includes shifting the sleeve within the tubular to expose the plurality of ports to the interior of the sleeve apparatus in the fully opened condition of the sleeve apparatus. A longitudinal shifting distance of the sleeve to move the sleeve apparatus from the closed condition to the fully open condition of the sleeve apparatus is less than the length of fluidic access provided by the plurality of ports in the fully open condition.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
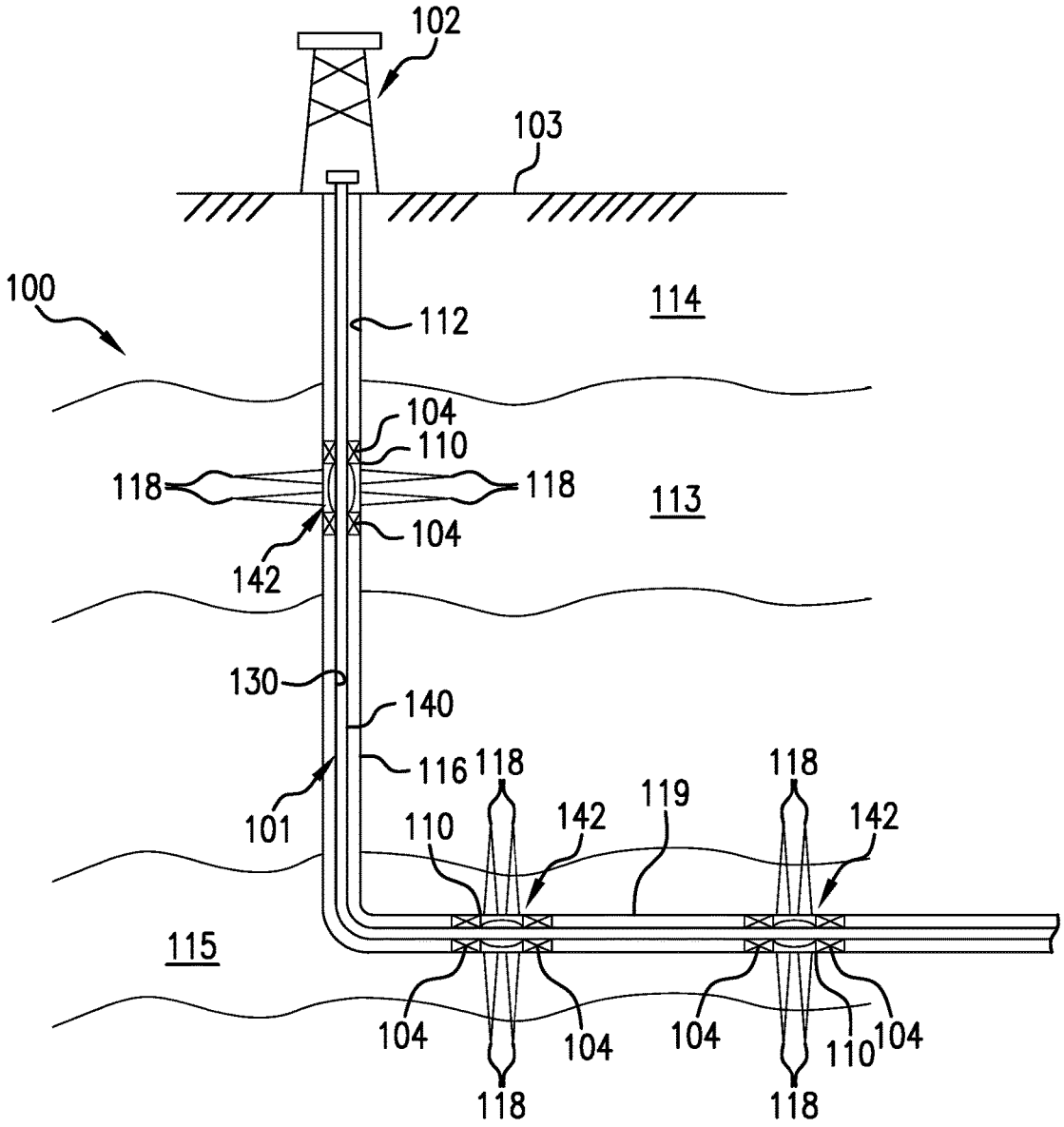
FIG. 1 shows a schematic view of an embodiment of a multi-zonal downhole system which incorporates a sleeve apparatus within a borehole.

FIG. 1 shows an embodiment of a downhole system 100. A borehole 112 has been drilled through an earth formation 114 and into a pair of production formations or reservoirs 113, 115. The borehole 112 may be cased and a number of perforations 118 penetrated and extending into the formations 113, 115 so that productions fluids may flow from the formations 113, 115 into the borehole 112. Alternatively, the borehole 112 may be uncased. In one embodiment, the borehole 112 may have a deviated or substantially horizontal leg 119. A string or downhole assembly, generally indicated at 101 is disposed within the borehole 112 and extends downwardly from a wellhead 102 at the surface 103. The assembly 101 has an interior 130 defining an internal axial flowbore along its length. An annulus 140 is defined between the assembly 101 and a borehole wall 116 or casing. Production zones 142 are shown positioned at selected locations along the assembly 101. Each zone 142 may be isolated within the borehole 112 by a pair of packer devices 104. Although only three production zones 142 are shown in FIG. 1, there may be any number of such zones arranged in serial fashion along the borehole 112. Each production zone 142 may include a sleeve apparatus 110 to govern one or more aspects of a flow of one or more fluids into or out of the assembly 101. As used herein, the term "fluid" or "fluids" includes liquids, gases, hydrocarbons, multi-phase fluids, mixtures of two or more fluids, water, brine, engineered fluids such as drilling mud, fluids injected from the surface, water, and naturally occurring fluids such as oil and gas. The sleeve apparatus 110 may include additional screens and shrouds necessary for preventing sand and debris from entering the interior 130. In accordance with embodiments of the present disclosure, the assembly 101 may further include other downhole tools and systems for operating downhole.

Figure 2A:
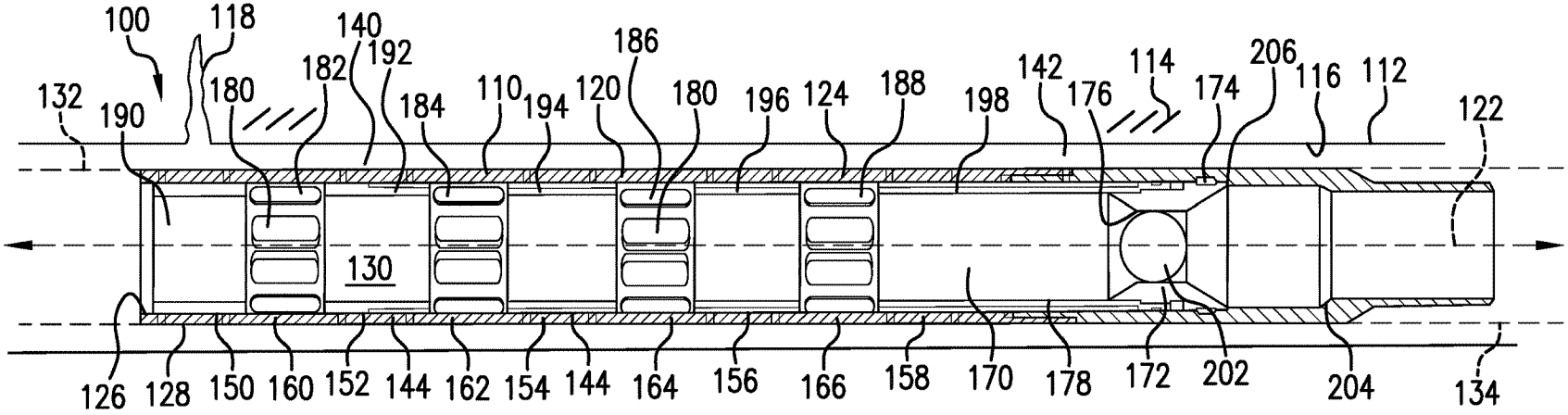
FIGS. 2A and 2B show sectional views of closed and open positions of an embodiment of a sleeve apparatus for the downhole system of FIG. 1.
Figure 2B:
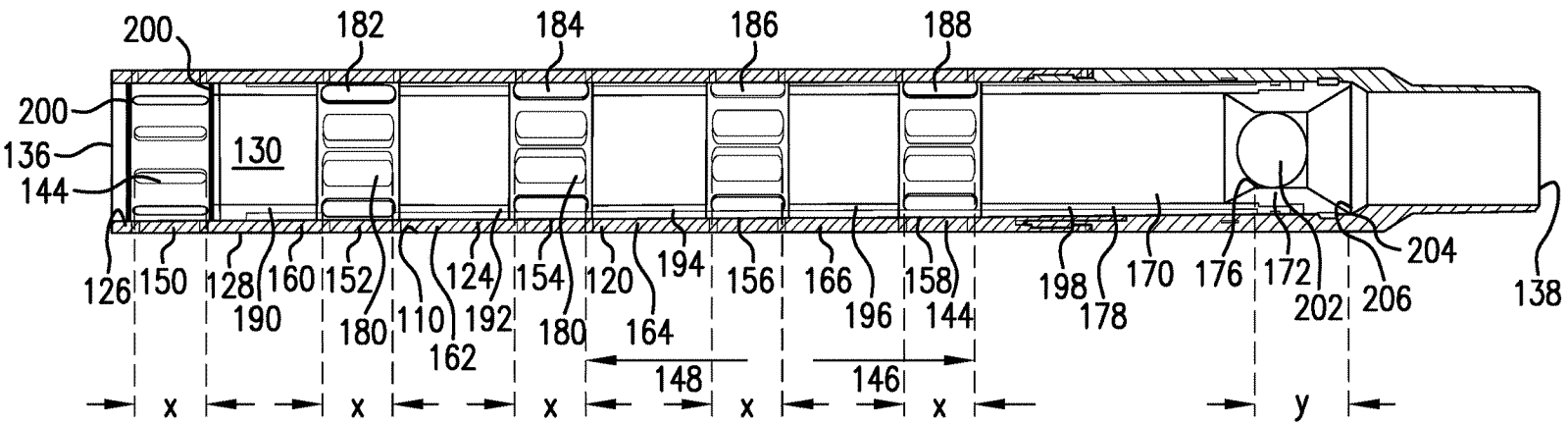

Referring to FIGS. 2A-2B, one embodiment of a portion of the downhole system 100 including an embodiment of the sleeve apparatus 110 is shown. FIG. 2A shows the sleeve apparatus 110 in a closed or run-in condition, and FIG. 2B shows the sleeve apparatus 110 in an open condition. The downhole system 100 is disposable within the borehole 112 extending through the formation 114 (or any of production formations 113, 115). The wall 116 of the borehole 112 may be fractured, such as at perforation 118, to enhance the extraction of natural resources from the formation 114. The sleeve apparatus 110 includes a tubular 120 having a longitudinal axis 122 and a wall 124. The wall 124 of the tubular 120 has an interior surface 126 and an exterior surface 128. An interior 130 defines the flowbore extending along the longitudinal axis 122. While only one sleeve apparatus 110 is illustrated, it should be understood that several zones 142 within the borehole 112 may be operated thereon using the downhole system 100, such as by connecting the tubular 120 to other sections 132, 134 (FIG. 2A) of the downhole assembly 101, such as by using threaded connections or other connectors at the uphole and downhole ends 136, 138, respectively, of the tubular 120. The annulus 140 is formed between the wall 124 of the tubular 120 and the wall 116 of the borehole 112 (or casing). The zone 142 of the annulus 140 adjacent the sleeve apparatus 110 may be isolated from adjacent zones by packers (see packer devices 104 in FIG. 1) positioned uphole and downhole of the zone 142. The downhole system 100 may additionally include other tubulars, sections, tools, and equipment needed for downhole operations.

The wall 124 of the tubular 120 includes a plurality of radial flow ports 144 there through. The ports 144 may be employable for injecting material in a downhole direction 146 through the interior 130 of the tubular 120, then radially outwardly through the ports 144 towards the borehole wall 116, or alternatively may be used for allowing production fluids to flow from the formation 114 radially inwardly through the ports 144, and then in an uphole direction 148 through the interior 130. As illustrated, in one embodiment of the sleeve apparatus 110, the plurality of ports 144 include at least two longitudinally separated banks 150, 152, 154, 156, and 158 of ports 144. Each bank 150-158 of ports 144 occupies a discrete longitudinal section of the tubular 120. The first bank 150 of ports 144 is longitudinally separated from the second bank 150 of ports 152 by a non-ported, imperforate section 160 of the tubular 120. In the illustrated embodiment, third, fourth, and fifth banks 154, 156, and 158 of ports 144 are additionally included in the wall 124 of the tubular 120, however any number of banks of ports 144 may be included which are respectively separated by a non-ported section 160, 162, 164, 166. The ports 144 are elongated in a longitudinal direction, such that a length of the ports 144 is greater than a width in the radial direction, and the ports 144 extend through a thickness of the wall 124. The ports 144 are additionally radially distributed about the tubular 120 within each bank. Radially adjacent ports 144 are radially separated from each other by portions of the wall 124.

Disposed interiorly of the tubular 120 is a movable sleeve 170 and plug seat 172. In the closed condition of the sleeve apparatus 110, at least one of the sleeve 170 and plug seat 172 is secured, such as shear pinned by one or more shear pins 174, to the tubular 120 to prevent premature movement of the sleeve 170 with respect to the tubular 120. Flow through the interior 130 and through the opening 176 in the plug seat 172 is insufficient to move the sleeve 170 and plug seat 172 in the downhole direction 146.

The sleeve 170 includes a wall 178 having a plurality of apertures 180. The apertures 180 are elongated in shape in the longitudinal direction and may have a peripheral area that is at least slightly greater than a peripheral area of the ports 144. The apertures 180 are arranged in a plurality of banks of apertures 180, such as first, second, third, and fourth banks 182, 184, 186, 188. The banks 182-188 of apertures 180 are alternated with non-apertured sections 190, 192, 194, 196, and 198 of the sleeve 170. In the closed condition of the sleeve apparatus 110, the non-apertured sections 190-198 of the sleeve 170 are longitudinally aligned with the ports 144 of the tubular 120, and the banks of apertures 180 are longitudinally aligned with the non-ported sections 160-166 of the tubular 120. Thus, in the closed condition of the sleeve apparatus 110, fluidic access between the ports 144 and the interior 130 of the sleeve apparatus 110 is prohibited. Fluid ingress in the closed condition of the sleeve apparatus 110 may be further blocked by seals 200 (FIG. 2B), such as O-rings, positioned uphole and downhole each bank of ports 144.

When opening of the sleeve apparatus 110 is desired, a plug 202, such as a ball, is dropped onto the seat 172 to block the opening 176. Pressure is increased within the downhole assembly 101 uphole of the plug 202. The increased pressure is sufficient to shear the shear pins 174, and the pressure across the plug 202 moves the plug 202, plug seat 172, and sleeve 170 in tandem in the downhole direction 146. In the open condition of the sleeve apparatus 110, the plug seat 172 has been forced in the downhole direction 146 until a stop surface 204 of the tubular 120, such as a shoulder, is reached by an abutting surface 206 of the plug seat 172. The plug seat 172 and/or tubular 120 may further include a locking mechanism to lock the plug seat 172 in place within the tubular 120 in the open condition of the sleeve apparatus 110, such as by an expandable portion of the plug seat 172 engaging with an inner receiving area of the tubular 120. During the shifting of the sleeve 170, all of the banks of ports 144 may be opened (unblocked) substantially simultaneously. When the plug seat 172 reaches the stop surface 204, the banks of apertures 180 are aligned with respective banks of ports 144. The first bank 150 of ports 144 may simply be uncovered and exposed to the interior of the sleeve apparatus 110. Thus, the number of banks of apertures 180 may be one less than a number of banks of ports 144.

In the fully open condition of the sleeve apparatus 110, the interior 130 is fluidically communicable with the annulus 140 through the ports 144, thus the ports 144 provide fluidic access between the interior 130 and the annulus 140. The fluidic access has a length component measured with respect to the longitudinal axis 122 and equal to a sum of the length of the longest port 144 in the first bank 150 of ports 144, plus the length of the longest port 144 in the second bank 152 of ports 144, plus the length of the longest port 144 in the third bank 154 of ports 144, plus the length of the longest port 144 in the fourth bank 156 of ports 144, plus the length of the longest port 144 in the fifth bank 158 of ports 144. For example, if the ports 144 have a same length "x" within each bank of ports 144, then the length of fluid access provided by the opened sleeve system 110, as illustrated in FIG. 2B, would be the number n of banks of ports 144 times the length x, or nx (e.g. 5x in the illustrated embodiment). The longitudinal shifting distance y, measured with respect to the longitudinal axis 122 from the closed position of the sleeve 120 and plug seat 170 to the open position of the sleeve 120 and plug 170, is at least x, may be approximately x, and is substantially less than the length of fluidic access nx (5x in the illustrated embodiment). In the embodiment shown, the longitudinal shifting distance y may be slightly greater than the port length x due in part to thickness of the seals 200, however the longitudinal shifting distance y is, in one embodiment, at least less than 2x. It should be understood that the longitudinal shifting distance y will be less than the length of fluid access nx, however actual distances and lengths will be determined based on needs for particular operations.

The apertures 180 in the sleeve 170 may be substantially rotationally aligned with the ports 144 in both closed and opened conditions of the sleeve apparatus 110, however the apertures 180 and ports 144 are longitudinally distanced from each other in the closed condition. To ensure that the apertures 180 and ports 144 remain rotationally aligned in the open condition, the sleeve 170 and the tubular 120 may be rotationally locked with respect to each other during movement of the sleeve 170, such as by, but not limited to, a protrusion extending from the sleeve 170 sliding within a longitudinal groove in the tubular 120. In an embodiment where the apertures 180 have a greater outer perimeter than that of the ports 144, exposure of the ports 144 to the interior of the sleeve apparatus 110 is ensured even if there is slight misalignment, either radially or longitudinally, between the ports 144 and apertures 180 in the open condition of the sleeve apparatus 110. In the open condition of the sleeve apparatus 110, the downhole system 100 may be used to produce fluids from the formation 114, through the aligned ports 144 and apertures 180, and in the uphole direction 148 towards surface 103. Alternatively, materials (such as, but not limited to, steam, frac fluids, chemicals, etc.) may be injected in the downhole direction 146 through the sleeve apparatus 110, through the aligned apertures 180 and ports 144, and directed radially into the annulus 140 and towards the borehole wall 116.

The sleeve apparatus 110 of FIGS. 2A-2B does not suffer from problems achieving the open condition despite the length of fluid access provided by the ports 144 within the sleeve apparatus 110. For example, in an embodiment where the length of fluid access is 5x, instead of needing to move a longitudinal shifting distance of at least 5x to reach the fully open condition, the sleeve 170 of the sleeve apparatus 110 only needs to move a shifting distance y of approximately 1x to open all of the ports 144. That is, the shifting distance for the sleeve system 110 is substantially less than a total length of fluid access (in one embodiment, 5x) provided by the ports 144. Due to the total length of the ports 144 in the tubular 120 divided over a number of different longitudinal sections, the sleeve apparatus 110 does not have any limitation on the length of fluid access that is to be opened. Thus, the pressure drop while opening the ports 144 is substantially less likely to affect the opening of the sleeve apparatus 110.

Figure 3A:
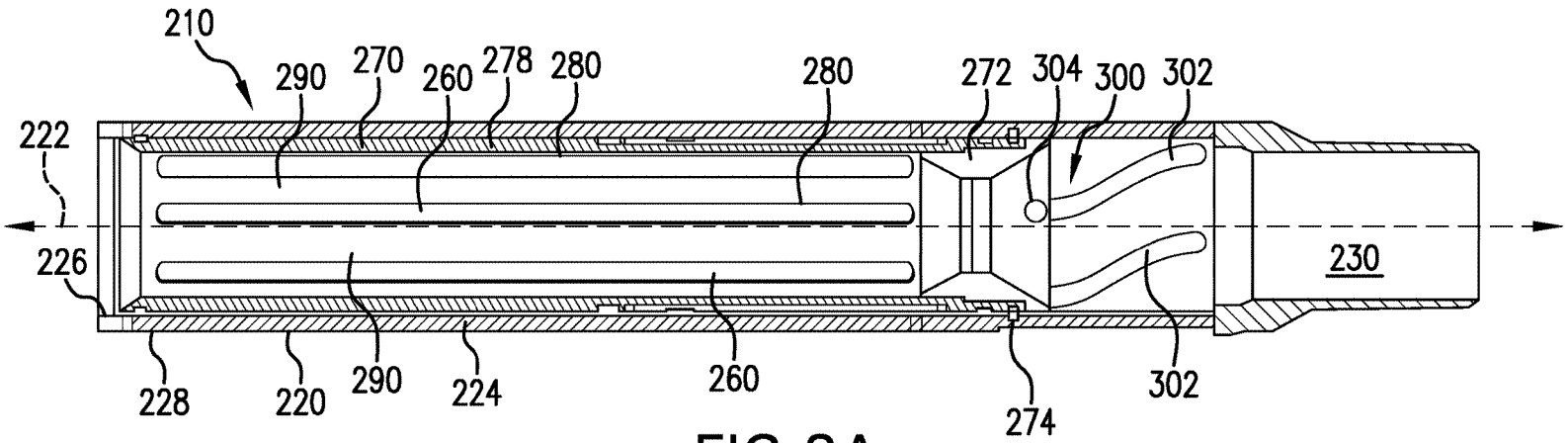
FIGS. 3A and 3B show sectional views of closed and open positions of another embodiment of a sleeve apparatus for the downhole system of FIG. 1; and, FIGS. 4A to 4C show sectional views of closed, partially open, and open positions of a sleeve apparatus according to the prior art.
Figure 3B:
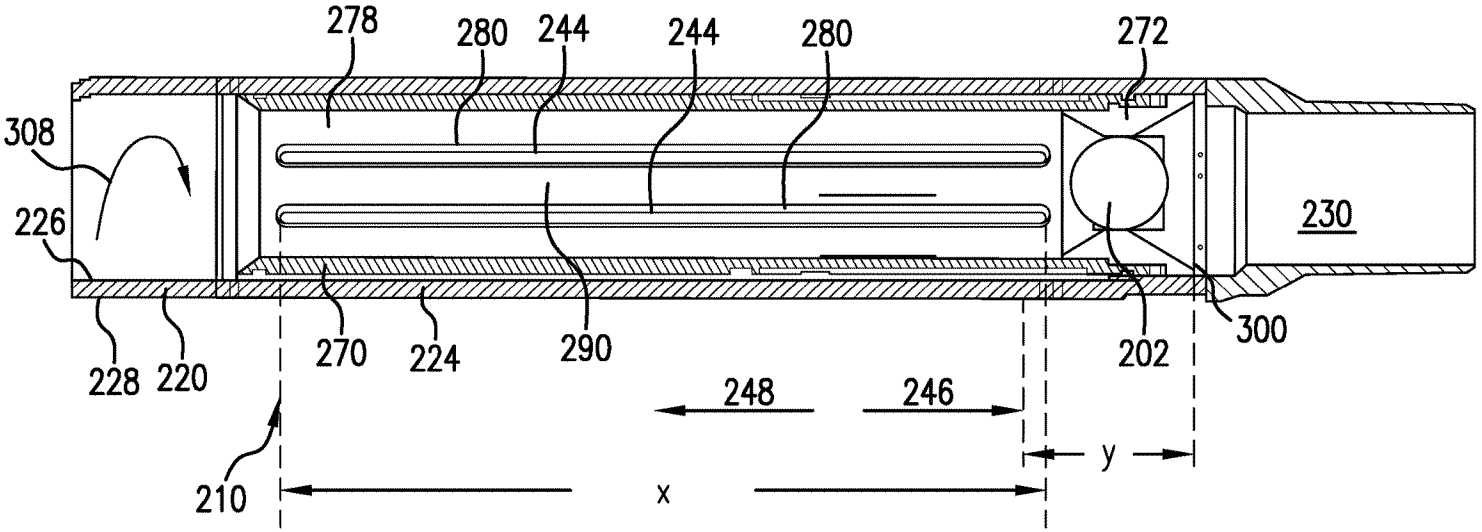

Another embodiment of a sleeve apparatus 210 for the downhole system 100 is shown in FIGS. 3A-3B. As in the sleeve apparatus 110, the sleeve apparatus 210 includes a tubular 220 having a longitudinal axis 222, wall 224 having interior and exterior surfaces 226, 228, and an interior 230 defining a flowbore. The tubular 220 further includes a set of ports 244, shown in FIG. 3B. The sleeve apparatus 210 further includes a sleeve 270 having a wall 278 and a set of apertures 280 extending through the wall 278. The apertures 280 are completely radially misaligned with the set of ports 244 in the closed condition of the sleeve apparatus 210, and are additionally partially longitudinally misaligned with the set of ports 244. In the closed condition of the sleeve apparatus 210, non-apertured sections 290 of the sleeve 270 are rotationally aligned with the ports 244 to block fluidic movement through the ports 244. Also, the apertures 280 are aligned with non-ported sections 260 of the tubular 220 in the closed condition. The sleeve 270 is attached at a downhole end to the plug seat 272, and the sleeve 270 and plug seat 272 are prohibited from unintentional movement within the tubular 220 when in the closed condition, such as by shear pins 274.

Figure 4A:
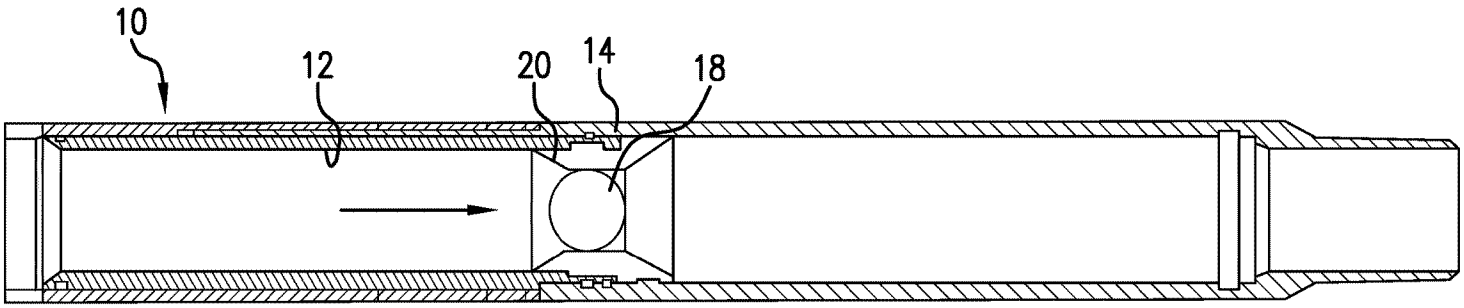
Figure 4B:
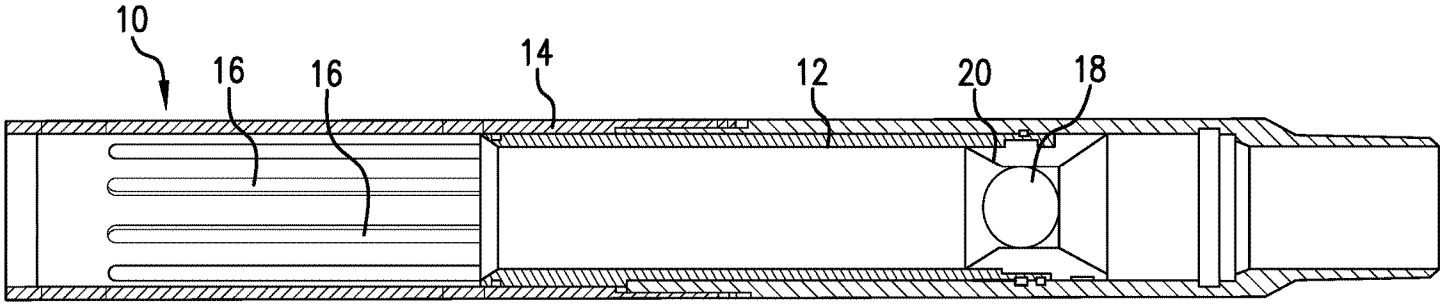
Figure 4C:
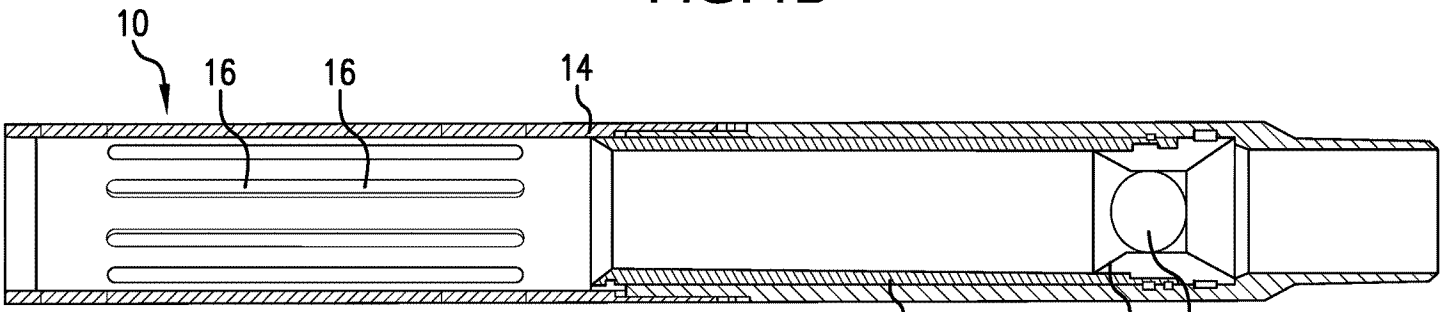

The sleeve 270 is movable within the tubular 220 through use of a mechanism 300 to convert linear to rotational motion. In one embodiment, the linear to rotational motion converting mechanism 300 includes at least one curved interior groove 302, such as a J-slot, provided on the interior surface 226 of the wall 224 of the tubular 220 and located downhole of the plug seat 272, when the plug seat 272 is in the closed condition of the sleeve apparatus 210. The mechanism 300 further includes at least one groove follower 304 attached to or otherwise protruding from at least one of the plug seat 272 and the sleeve 270. Alternatively, the mechanism 300 may include one or more grooves 302 within a radially exterior surface of the plug seat 272 or sleeve 270, with a fixed groove follower 304 protruding radially interiorly from the tubular 220. When movement to the open condition is desired, a plug 202, such as a ball, is dropped onto the seat 272 and pressure is increased within the tubular 220 uphole of the plug 202. The increased pressure is sufficient to shear the shear pins 274 that secure the sleeve 270 to the tubular 220, and the pressure across the plug 202 moves the plug 202, plug seat 272, and sleeve 270 in tandem in the downhole direction 246. However, due to the linear to rotational motion converting mechanism 300, such as the groove 302 and groove follower 304, the sleeve 270 additionally rotates in rotational direction 308 until the groove follower 304 reaches the end of the groove 302, or alternatively or additionally until an abutting surface of the plug seat 272 engages with a stop surface of the tubular 220. As in the previous embodiment, the longitudinal shifting distance y required to longitudinally shift the sleeve 270 with respect to the tubular 220 is substantially less than in the conventional sleeve apparatus shown in FIGS. 4A-4C. Further, the longitudinal shifting distance y is substantially less than a length of fluidic access nx (where n=1) provided by the ports 244. The length of fluidic access in this embodiment is simply the length x of the longest port 244 amongst the ports 244 (although they may all have the same length x as in the illustrated embodiment), and the sleeve 270 only needs to shift longitudinally a length of the groove 302 that is required to additionally rotate the sleeve 270. Thus, problems achieving the open condition of the sleeve apparatus 210 are avoided, regardless of the length of the ports 244.

Thus, the sleeve apparatuses 110 and 210 provide high flow area with minimal sleeve activation distance. A method of providing high flow area while activating the sleeves 170 and 270 of the sleeve apparatuses 110 and 210 is further provided, and includes a method of accessing an annulus in a borehole, the method including running a downhole assembly into a borehole, the downhole assembly having an interior defining a flowbore, and further including a sleeve apparatus connected along the assembly, the sleeve apparatus having a longitudinal axis and an interior, the sleeve apparatus further including a tubular having a plurality of ports providing a length of fluidic access between the interior of the sleeve apparatus and an exterior of the tubular; and, a sleeve disposed within the tubular, the sleeve having a plurality of apertures misaligned with the plurality of ports in a closed condition of the sleeve apparatus, the sleeve further having a plurality of non-apertured sections aligned with the plurality of ports in the closed condition; and, shifting the sleeve within the tubular to expose the plurality of ports to the interior of the sleeve apparatus in a fully opened condition of the sleeve apparatus. A longitudinal shifting distance of the sleeve to move the sleeve apparatus from the closed condition to the fully open condition of the sleeve apparatus is less than the length of fluidic access provided by the plurality of ports in the fully open condition.

Set forth below are some embodiments of the foregoing disclosure:

Embodiment 1: A sleeve apparatus having a longitudinal axis and an interior, the sleeve apparatus further comprising: a tubular having a plurality of ports providing a length of fluidic access between the interior of the sleeve apparatus and an exterior of the tubular, the length measured with respect to the longitudinal axis; and, a sleeve disposed within the tubular and configured to move longitudinally with respect to the longitudinal axis, the sleeve having a plurality of apertures misaligned with the plurality of ports in a closed condition of the sleeve apparatus and at least substantially aligned with the plurality of ports in a fully open condition of the sleeve apparatus, the sleeve further having a plurality of non-apertured sections aligned with the plurality of ports in the closed condition; wherein a longitudinal shifting distance of the sleeve to move the sleeve apparatus from the closed condition to the fully open condition of the sleeve apparatus exposing the plurality of ports to the interior of the sleeve apparatus is less than the length of fluidic access provided by the plurality of ports in the fully open condition.

Embodiment 2: The sleeve apparatus of embodiment 1, further comprising a plug seat configured to receive a plug, the sleeve movable with the plug seat.

Embodiment 3: The sleeve apparatus of embodiment 2, wherein the plug seat is shear pinned to the tubular in the closed condition of the sleeve apparatus, and sheared from the tubular in the open condition of the sleeve apparatus.

Embodiment 4. The sleeve apparatus of embodiment 1, wherein the plurality of ports in the tubular includes at least two banks of ports longitudinally separated, respectively, by a non-ported section of the tubular.

Embodiment 5. The sleeve apparatus of embodiment 4, wherein the tubular includes n banks of ports and the sleeve includes n−1 banks of apertures.

Embodiment 6. The sleeve apparatus of embodiment 4, wherein the tubular includes n banks of ports, the plurality of ports each have a substantially same length, and the length of fluidic access provided by the plurality of ports is the length of the ports times n.

Embodiment 7. The sleeve apparatus of embodiment 4, wherein the ports in each bank of ports have a length approximately equal to the longitudinal shifting distance of the sleeve.

Embodiment 8. The sleeve apparatus of embodiment 4, further comprising a seal uphole and downhole each bank of ports.

Embodiment 9. The sleeve apparatus of embodiment 1, wherein the plurality of apertures are rotationally misaligned with the plurality of ports in the closed condition of the sleeve apparatus.

Embodiment 10. The sleeve apparatus of embodiment 9, wherein motion of the sleeve in the longitudinal shifting distance additionally rotates the sleeve about the longitudinal axis to rotationally and longitudinally align the plurality of apertures with the plurality of ports in the fully opened condition of the sleeve apparatus.

Embodiment 11. The sleeve apparatus of embodiment 10, further comprising a curved groove in one of the tubular and the sleeve, wherein movement of the sleeve in the longitudinal shifting distance follows the curve to rotate the sleeve.

Embodiment 12. The sleeve apparatus of embodiment 11, further comprising a protrusion protruding from one of the tubular and the sleeve to follow in the groove during movement of the sleeve in the longitudinal shifting distance.

Embodiment 13. The sleeve apparatus of embodiment 1, wherein the tubular further includes a J-slot, wherein the sleeve is configured to rotate with respect to the tubular during movement of the sleeve in the longitudinal shifting distance.

Embodiment 14. A downhole system comprising an assembly configured to extend through a borehole, the assembly having an interior defining a flowbore, the downhole system further comprising: a sleeve apparatus connected along the assembly, the sleeve apparatus having a longitudinal axis and an interior, the sleeve apparatus further including: a tubular having a plurality of ports providing a length of fluidic access between the interior of the sleeve apparatus and an exterior of the tubular, the length measured with respect to the longitudinal axis; and, a sleeve disposed within the tubular and configured to move longitudinally with respect to the longitudinal axis, the sleeve having a plurality of apertures misaligned with the plurality of ports in a closed condition of the sleeve apparatus and at least substantially aligned with the plurality of ports in a fully open condition of the sleeve apparatus, the sleeve further having a plurality of non-apertured sections aligned with the plurality of ports in the closed condition; wherein a longitudinal shifting distance of the sleeve to move the sleeve apparatus from the closed condition to the fully open condition of the sleeve apparatus exposing the plurality of ports to the interior of the sleeve apparatus is less than the length of fluidic access provided by the plurality of ports in the fully open condition.

Embodiment 15. The downhole system of embodiment 14, further comprising a plug seat attached to the sleeve, and a plug receivable within the plug seat to shift the sleeve in the longitudinal shifting distance.

Embodiment 16. The downhole system of embodiment 14, wherein the longitudinal shifting distance is x and the length of fluidic access provided by the plurality of ports is at least 2x.

Embodiment 17. The downhole system of embodiment 14, further comprising a plurality of the sleeve apparatuses connected along the assembly, and a plurality of packer devices disposed uphole and downhole of each sleeve apparatus to isolate a plurality of zones within the borehole.

Embodiment 18. A method of accessing an annulus in a borehole, the method comprising: running a downhole assembly into a borehole, the downhole assembly having an interior defining a flowbore, and further comprising a sleeve apparatus connected along the assembly, the sleeve apparatus having a longitudinal axis and an interior, the sleeve apparatus further including a tubular having a plurality of ports providing a length of fluidic access between the interior of the sleeve apparatus and an exterior of the tubular, the length measured with respect to the longitudinal axis; and, a sleeve disposed within the tubular and configured to move longitudinally with respect to the longitudinal axis, the sleeve having a plurality of apertures misaligned with the plurality of ports in a closed condition of the sleeve apparatus and at least substantially aligned with the plurality of ports in a fully open condition of the sleeve apparatus, the sleeve further having a plurality of non-apertured sections aligned with the plurality of ports in the closed condition; and, shifting the sleeve within the tubular to expose the plurality of ports to the interior of the sleeve apparatus in the fully opened condition of the sleeve apparatus; wherein a longitudinal shifting distance of the sleeve to move the sleeve apparatus from the closed condition to the fully open condition of the sleeve apparatus is less than the length of fluidic access provided by the plurality of ports in the fully open condition.

Embodiment 19. The method of embodiment 18, wherein the plurality of ports in the tubular includes at least two banks of ports longitudinally separated, respectively, by a non-ported section of the tubular, and shifting the sleeve includes shifting the sleeve longitudinally to unblock each bank of ports substantially simultaneously.

Embodiment 20. The method of embodiment 18, wherein the plurality of apertures are rotationally misaligned with the plurality of ports in the closed condition of the sleeve apparatus, and shifting the sleeve includes converting longitudinal motion of the sleeve into rotational motion of the sleeve to rotationally and longitudinally align the plurality of apertures with the plurality of ports in the fully opened condition of the sleeve apparatus.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A sleeve apparatus having a longitudinal axis and an interior, the sleeve apparatus further comprising:

a tubular having a plurality of ports providing a length of fluidic access between the interior of the sleeve apparatus and an exterior of the tubular, the length measured with respect to the longitudinal axis; and, a sleeve disposed within the tubular and configured to move longitudinally with respect to the longitudinal axis, the sleeve having a plurality of apertures misaligned with the plurality of ports in a closed condition of the sleeve apparatus and at least substantially aligned with the plurality of ports in a fully open condition of the sleeve apparatus, the sleeve further having a plurality of non-apertured sections aligned with the plurality of ports in the closed condition;

wherein a longitudinal shifting distance of the sleeve to move the sleeve apparatus from the closed condition to the fully open condition of the sleeve apparatus exposing the plurality of ports to the interior of the sleeve apparatus is less than the length of fluidic access provided by the plurality of ports in the fully open condition.

2. The sleeve apparatus of claim 1, further comprising a plug seat configured to receive a plug, the sleeve movable with the plug seat.

3. The sleeve apparatus of claim 2, wherein the plug seat is shear pinned to the tubular in the closed condition of the sleeve apparatus, and sheared from the tubular in the open condition of the sleeve apparatus.

4. The sleeve apparatus of claim 1, wherein the plurality of ports in the tubular includes at least two banks of ports longitudinally separated, respectively, by a non-ported section of the tubular.

5. The sleeve apparatus of claim 4, wherein the tubular includes n banks of ports and the sleeve includes n−1 banks of apertures.

6. The sleeve apparatus of claim 4, wherein the tubular includes n banks of ports, the plurality of ports each have a substantially same length, and the length of fluidic access provided by the plurality of ports is the length of the ports times n.

7. The sleeve apparatus of claim 4, wherein the ports in each bank of ports have a length approximately equal to the longitudinal shifting distance of the sleeve.

8. The sleeve apparatus of claim 4, further comprising a seal uphole and downhole each bank of ports.

9. The sleeve apparatus of claim 1, wherein the plurality of apertures are rotationally misaligned with the plurality of ports in the closed condition of the sleeve apparatus.

10. The sleeve apparatus of claim 9, wherein motion of the sleeve in the longitudinal shifting distance additionally rotates the sleeve about the longitudinal axis to rotationally and longitudinally align the plurality of apertures with the plurality of ports in the fully opened condition of the sleeve apparatus.

11. The sleeve apparatus of claim 10, further comprising a curved groove in one of the tubular and the sleeve, wherein movement of the sleeve in the longitudinal shifting distance follows the curve to rotate the sleeve.

12. The sleeve apparatus of claim 11, further comprising a protrusion protruding from one of the tubular and the sleeve to follow in the groove during movement of the sleeve in the longitudinal shifting distance.

13. The sleeve apparatus of claim 1, wherein the tubular further includes a J-slot, wherein the sleeve is configured to rotate with respect to the tubular during movement of the sleeve in the longitudinal shifting distance.

14. A downhole system comprising an assembly configured to extend through a borehole, the assembly having an interior defining a flowbore, the downhole system further comprising:

a sleeve apparatus connected along the assembly, the sleeve apparatus having a longitudinal axis and an interior, the sleeve apparatus further including:

a tubular having a plurality of ports providing a length of fluidic access between the interior of the sleeve apparatus and an exterior of the tubular, the length measured with respect to the longitudinal axis; and, a sleeve disposed within the tubular and configured to move longitudinally with respect to the longitudinal axis, the sleeve having a plurality of apertures misaligned with the plurality of ports in a closed condition of the sleeve apparatus and at least substantially aligned with the plurality of ports in a fully open condition of the sleeve apparatus, the sleeve further having a plurality of non-apertured sections aligned with the plurality of ports in the closed condition;

wherein a longitudinal shifting distance of the sleeve to move the sleeve apparatus from the closed condition to the fully open condition of the sleeve apparatus exposing the plurality of ports to the interior of the sleeve apparatus is less than the length of fluidic access provided by the plurality of ports in the fully open condition.

15. The downhole system of claim 14, further comprising a plug seat attached to the sleeve, and a plug receivable within the plug seat to shift the sleeve in the longitudinal shifting distance.

16. The downhole system of claim 14, wherein the longitudinal shifting distance is x and the length of fluidic access provided by the plurality of ports is at least 2x.

17. The downhole system of claim 14, further comprising a plurality of the sleeve apparatuses connected along the assembly, and a plurality of packer devices disposed uphole and downhole of each sleeve apparatus to isolate a plurality of zones within the borehole.

18. A method of accessing an annulus in a borehole, the method comprising:

running a downhole assembly into a borehole, the downhole assembly having an interior defining a flowbore, and further comprising a sleeve apparatus connected along the assembly, the sleeve apparatus having a longitudinal axis and an interior, the sleeve apparatus further including a tubular having a plurality of ports providing a length of fluidic access between the interior of the sleeve apparatus and an exterior of the tubular, the length measured with respect to the longitudinal axis; and, a sleeve disposed within the tubular and configured to move longitudinally with respect to the longitudinal axis, the sleeve having a plurality of apertures misaligned with the plurality of ports in a closed condition of the sleeve apparatus and at least substantially aligned with the plurality of ports in a fully open condition of the sleeve apparatus, the sleeve further having a plurality of non-apertured sections aligned with the plurality of ports in the closed condition; and, shifting the sleeve within the tubular to expose the plurality of ports to the interior of the sleeve apparatus in the fully opened condition of the sleeve apparatus;

wherein a longitudinal shifting distance of the sleeve to move the sleeve apparatus from the closed condition to the fully open condition of the sleeve apparatus is less than the length of fluidic access provided by the plurality of ports in the fully open condition.

19. The method of claim 18, wherein the plurality of ports in the tubular includes at least two banks of ports longitudinally separated, respectively, by a non-ported section of the tubular, and shifting the sleeve includes shifting the sleeve longitudinally to unblock each bank of ports substantially simultaneously.

20. The method of claim 18, wherein the plurality of apertures are rotationally misaligned with the plurality of ports in the closed condition of the sleeve apparatus, and shifting the sleeve includes converting longitudinal motion of the sleeve into rotational motion of the sleeve to rotationally and longitudinally align the plurality of apertures with the plurality of ports in the fully opened condition of the sleeve apparatus.

* * * * *